United States Patent [19]

Montgomery et al.

[11] Patent Number: 4,713,221

[45] Date of Patent: Dec. 15, 1987

[54] CRUDE OIL REFINING APPARATUS

[75] Inventors: Dean P. Montgomery; James W. Gall, both of Bartlesville, Okla.; Ed D. Davis, Borger, Tex.

[73] Assignee: Phillips Petroleum Company, Bartlesville, Okla.

[21] Appl. No.: 776,280

[22] Filed: Sep. 16, 1985

Related U.S. Application Data

[62] Division of Ser. No. 613,944, May 25, 1984, Pat. No. 4,565,620.

[51] Int. Cl.[4] ..... B01J 8/04; C10G 69/14

[52] U.S. Cl. ..... 422/190; 208/57; 208/61; 208/68; 208/80; 422/234

[58] Field of Search ..... 208/57, 61, 68, 78, 208/80, 92, 93, 108, 210, 113, 251 H, 264; 422/190, 211, 234, 188, 189; 196/46, 46.1

[56] References Cited

U.S. PATENT DOCUMENTS

| | | | |
|---|---|---|---|
| 2,279,550 | 4/1942 | Benedict et al. | 208/57 |
| 2,792,336 | 5/1957 | Kubicek et al. | 208/80 X |
| 2,801,208 | 7/1957 | Horne et al. | 208/61 |
| 2,911,352 | 11/1959 | Goretta et al. | 208/80 X |
| 2,945,803 | 7/1960 | Beuther et al. | 208/92 X |
| 3,098,029 | 7/1963 | Snyder, Jr. | 208/61 |
| 3,185,639 | 5/1965 | Paterson | 208/78 X |
| 3,190,828 | 6/1965 | Daniel et al. | 422/190 X |
| 3,193,488 | 7/1965 | Carr | 208/68 |
| 3,287,254 | 11/1966 | Paterson | 208/93 X |
| 3,505,208 | 4/1970 | Vaell | 422/190 X |
| 3,591,485 | 7/1971 | Mason, Jr. | 208/78 |
| 3,617,494 | 11/1971 | Montgomery | 208/80 |
| 3,637,483 | 1/1972 | Carey | 208/92 X |
| 3,726,789 | 4/1973 | Kovach | 208/61 X |
| 3,730,875 | 5/1973 | Gleim et al. | 208/57 |
| 3,761,399 | 9/1973 | McKinney et al. | 208/210 |
| 3,775,303 | 11/1973 | McKinney et al. | 208/210 |
| 3,775,304 | 11/1973 | McKinney et al. | 208/210 |
| 3,775,305 | 11/1973 | McKinney et al. | 208/210 |
| 4,025,417 | 5/1977 | Pavlica | 208/57 |
| 4,345,993 | 8/1982 | Stewart | 208/113 X |
| 4,363,716 | 11/1982 | Greene et al. | 208/80 |
| 4,370,220 | 1/1983 | Bearden et al. | 208/108 |

OTHER PUBLICATIONS

Gruse and Stevens, *The Chemical Technology of Petroleum,* 2nd Edition, McGraw-Hill Book Co., 1942, p. 50.

*Primary Examiner*—Richard L. Chiesa
*Attorney, Agent, or Firm*—Paul S. Chirgott

[57] ABSTRACT

In a crude oil refining apparatus, heavy cycle oil from the catalytic cracking unit employed in the crude oil refining apparatus is recycled to a hydrofining process. Such recycling improves the value of the product mix obtained from the crude oil refining apparatus with respect to an apparatus in which the heavy cycle oil withdrawn from the catalytic cracking units is recycled to the catalytic cracking units.

4 Claims, 2 Drawing Figures

CRUDE OIL REFINING APPARATUS

This application is a division of application Ser. No. 613,944 filed May 25, 1984 and now U.S. Pat. No. 4,565,620, issued Jan. 21, 1986.

This invention relates to crude oil refining. In one aspect, this invention relates to improving the value of the product mix obtained in a crude oil refining process.

Many steps may be involved in the refining of crude oil to produce desired products. At least two steps which are usually involved in refining of crude oil are fractional distillation and catalytic cracking.

Typically, a crude oil feed is first provided to a crude tower. The crude oil will have been preheated and/or heat is provided to the crude tower by heating fluids such as steam. Lighter components of the crude oil are removed from upper portions of the crude tower while heavier components are removed from lower portions of the crude tower.

The heavy fraction, which is generally referred to as gas oil, is typically provided to a catalytic cracking unit which is generally referred to as the gas oil cracker. The gas oil is cracked to produce lighter, more valuable components in the catalytic cracking unit.

In the past, it has been common to dispose of components of the crude oil which are heavier than the gas oil and which were considered very low value products. However, as it has become necessary to process heavier crudes, it has become more economically desirable to process the components of crude oil which are heavier than gas oil.

It is well known that crude oil may contain components which make processing difficult. As an example, crude oil will generally contain metals such as vanadium, nickel and iron. Such metals will tend to concentrate in the heavier fractions such as the topped crude and residuum. The presence of the metals makes further processing of these heavier fractions difficult since the metals generally act as poisons for catalysts employed in processes such as catalytic cracking.

The presence of other components such as sulfur and nitrogen is also considered detrimental to the processability of the hydrocarbon-containing feed stream. Again, sulfur and nitrogen will tend to concentrate in the heavier fractions. Also, the heavier fractions may contain components (referred to as Ramsbottom carbon residue) which are easily converted to coke in processes such as catalytic cracking.

Processes used to remove components such as metals, sulfur, nitrogen and Ramsbottom carbon residue are often referred to as hydrofining processes (one or all of the described removals may be accomplished in a hydrofining process). Hydrofining processes are used in many refineries to facilitate the processing of heavy fractions of the crude oil such as topped crude and residuum.

In addition to removing undesired components, a hydrofining process will often reduce the amount of heavies in the feedstock to the hydrofining process. This reduction results in the production of lighter components. Typically, when a hydrofining process is used in the refining of crude oil, the gas oil components withdrawn from the hydrofining process are provided to the catalytic cracking unit utilized to crack the gas oil withdrawn from the crude tower. Heavy fractions from the hydrofining unit are typically provided to a second catalytic cracker which is generally referred to as the heavy oil cracker.

In any process for refining crude oil, including processes where hydrofining is practiced, it is desirable to produce a product mix having the highest possible value. High value is determined by determining the amount of each product produced from a barrel of crude oil. The economic value of each product is then determined and a summation gives the value of the product mix. Even very small increases in the value of the product mix are extremely desirable because of the very large volumes of crude oil typically processed in a refinery and also because of the highly competitive nature of the crude oil refining business.

It is thus an object of this invention to provide apparatus and method for improving the value of the product mix obtained in a crude oil refining process where a hydrofining process is utilized to improve the processability of the heavy fractions withdrawn from a crude tower.

In accordance with the present invention, method and apparatus is provided whereby heavy cycle oil from the catalytic cracking units employed in a process for refining crude oil is recycled to a hydrofining unit. Such recycling improves the value of the product mix obtained from the crude oil refining process with respect to a process in which heavy cycle oils withdrawn from the catalytic cracking units are recycled to the catalytic cracking units.

Other objects and advantages of the invention will be apparent from the foregoing brief description of the invention and from the claims as well as the detailed description of the drawings which are briefly described as follows:

DETAILED DESCRIPTION OF THE DRAWINGS

Figure 1:
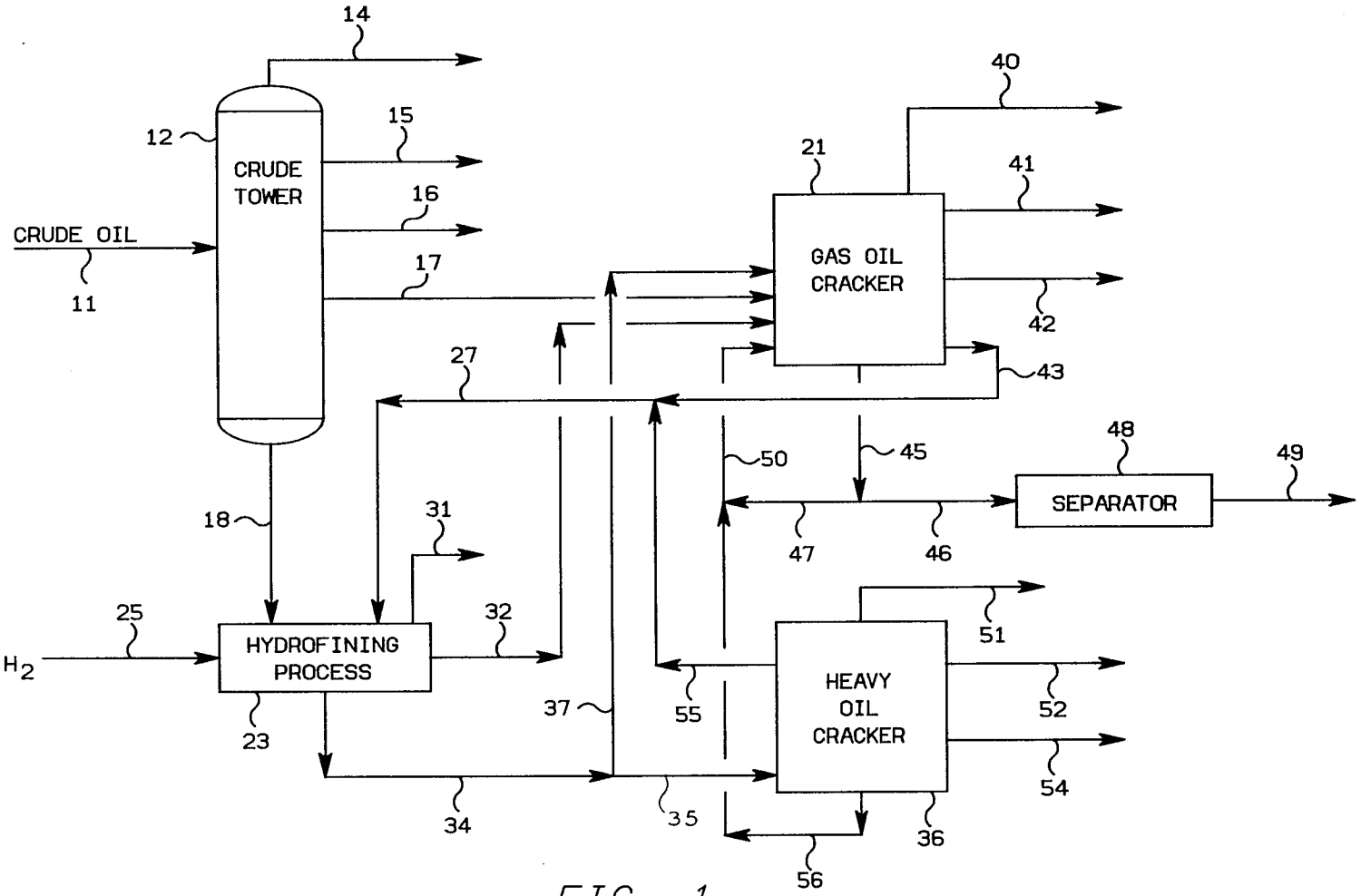
FIG. 1 is a diagrammatic illustration of a crude oil refining process employing the heavy cycle oil recycle of the present invention.

Referring now to the drawings and in particular to FIG. 1, a crude oil feed is provided through conduit means 11 to the crude tower 12. Typically, the crude oil will have been preheated or heat may be provided by a heating medium such as steam (not illustrated) which is circulated through the liquid in the bottom of the crude tower 12.

Several reflux streams and pump around streams would be associated with the crude tower. However, since only the products withdrawn from the crude tower are of importance in describing the present invention, only those products are illustrated. Gases from the crude tower are withdrawn through conduit means 14. A naphtha side draw stream is withdrawn through conduit means 15. A distillate side draw stream is withdrawn through conduit means 16. Gas oil is withdrawn through conduit means 17. Topped crude is withdrawn through conduit means 18.

Depending upon the operating conditions for the crude tower, the gases and boiling ranges for the products withdrawn from the crude tower may vary. However, the gases and the boiling ranges typically will be as set forth in Table I.

TABLE I

| Product | Boiling Range*** |
|---|---|
| Gases (Conduit 14) | methane, ethane, propane, $H_2S$ and CO |
| Naphtha (Conduit 15) | 89° to 388° F., ASTM D86 |
| Distillate (Conduit 16) | 298° F. to 557° F., ASTM D86 |
| Gas Oil (Conduit 17) | 299° F. to 764° F.*, ASTM D1160 |
| Topped Crude (Conduit 18) | 506° F. to 1029° F.**, ASTM D1160 |

*90% overhead temperature
**50% overhead temperature
***ASTM D86 is atmospheric and ASTM D1160 is vacuum distillation.

The light gases, naphtha and distillate draws may be further processed or purified. However, such other processing or purification does not play any part in the description of the present invention and is not described hereinafter.

The gas oil draw flowing through conduit means 17 is provided as a feed to the gas oil cracker 21. The operation of the gas oil cracker 21 will be described more fully hereinfter. The topped crude flowing through conduit means 18 is provided as a feed to the hydrofining unit 23. Also, hydrogen is provided through conduit means 25 and heavy cycle oil through conduit means 27 to the hydrofining unit 23.

The hydrofining unit 23 may employ any suitable hydrofining apparatus and process. The hydrofining unit will contain at least a reactor vessel associated with separation means such as a fractionator. Typically, the feed to the hydrofining unit is contacted with a supported catalyst in the presence of free hydrogen to remove undesired components and also reduce the concentration of heavies.

Typical supports for the catalyst are alumina, silica or silica alumina with alumina being widely used. The promoter is generally at least one metal selected from the group consisting of the metals of Group VIB, Group VIIB and Group VIII of the Periodic Table. Promoters which are typically used are iron, cobalt, nickel, tungsten, molybdenum, chromium, magnesia (magnesium oxide), vanadium and platinum. Cobalt, nickel, molybdenum and tungsten are the most widely used promoters. Pertinent properties of four commercial catalysts which are utilized in hydrofining processes are set forth in Table II.

TABLE II

| Catalyst | CoO (Wt. %) | MoO (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D. Harshaw Chemical Company | 0.92 | 7.3 | 0.53 | — | 178 |

*Measured on 20/40 mesh particles, compacted.

Conditions used in hydrofining processes vary widely. Typical conditions are set forth in Table III.

TABLE III

| HYDROFINING PROCESS VARIABLE | RANGE |
|---|---|
| Reaction time between catalyst and feed | 0.1 hours–10 hours |
| Temperature | 150° C.–550° C. (302° F.–1022° F.) |
| Hydrogen pressure | atmospheric-5,000 psig |
| Quantity of hydrogen added | 100–8,000 SCF of hydrogen per barrel of feed |

For the particular refining process to which the present invention is applied, three product streams are withdrawn from the hydrofining unit 23. These product streams are a gas stream withdrawn through conduit means 31, a gas oil stream withdrawn through conduit means 32 and a 750° F. plus cut withdrawn through conduit means 34. The gas oil withdrawn through conduit means 32 has basically the same characteristics as the gas oil withdrawn through conduit means 17 of the crude tower 12. The gases withdrawn through conduit means 31 have basically the same composition as the gases withdrawn through conduit means 14 of the crude tower 12 except for some increased hydrogen, hydrogen sulfide and ammonia content in conduit means 31.

The gas oil withdrawn through conduit means 32 is provided as a feed to the gas oil cracker 21. Most of the heavy fraction withdrawn through conduit 34 is provided as the feed to the heavy oil cracker 36 through conduit 35. However, for the process to which the present invention is applied, a portion of the heavy fraction flowing through conduit 34 is provided to the gas oil cracker 21 through conduit 37. If desired, all of the heavy fraction can be supplied to the heavy oil cracker 36.

The gas oil cracker 21 is a conventional catalytic cracking unit such as is illustrated and described in U.S. Pat. No. 4,345,993. Typically, a catalytic cracking unit will contain at least a reactor, a catalyst regenerator and a main fractionator. Since the operation of a catalytic cracking unit is well known and does not play any part in the description of the present invention, such operation is not fully described hereinafter.

For the particular refining process to which the present invention is applied, five product streams are withdrawn from the gas oil cracker 21. These product streams are gases withdrawn through conduit 40, gasoline withdrawn through conduit 41, light cycle oil withdrawn through conduit 42, heavy cycle oil withdrawn through conduit 43 and slurry and decant oil withdrawn through conduit 45. The boiling ranges for these products withdrawn from the gas oil cracker are set forth in Table IV. The gases are similar to the gases withdrawn through conduit 14 with the addition of olefins of the same carbon numbers.

TABLE 1

| | β(%) | | | | |
|---|---|---|---|---|---|
| α(%) | 60 | 65 | 70 | 75 | 80 |
| 40 | 1.25 | 1.79 | 2.5 | 3.49 | 5.02 |
| 45 | 0.83 | 1.27 | 1.86 | 2.66 | 3.87 |
| 50 | 0.5 | 0.86 | 1.33 | 2.0 | 3.0 |
| 55 | — | 0.52 | 0.92 | 1.45 | 2.78 |
| 60 | — | — | 0.56 | 1.0 | 1.67 |

A first portion of the slurry and decant oil withdrawn through conduit 45 is provided through conduit 46 to the separator 48. Catalyst fines and other undesired materials are separated from the slurry and decant oil flowing through conduit means 46 and the resulting product is withdrawn through conduit means 49. The product flowing through conduit means 49 can be used as a carbon black feed.

A second portion of the slurry withdrawn through conduit 45 flows through conduit 47. This slurry is combined with the slurry flowing through conduit 56, which will be more fully described hereinafter, and the resulting combination is recycled through conduit 50 to the main fractionator of the gas oil cracker 21.

The heavy oil cracker 36 is basically the same as the gas oil cracker 21. Again, the operation of a heavy oil cracker is well known and, since such operation does not play a part in the description of the present inventoion, such operation is not more fully described hereinafter.

For the particular refining process to which the present process is applied, five product streams are withdrawn from the heavy oil cracker 36. These product streams are a light gas stream withdrawn through conduit means 51, a gasoline stream withdrawn through conduit 52, a light cycle oil withdrawn through conduit 54, a heavy cycle oil withdrawn through conduit 55 and a slurry withdrawn through conduit 56. The composition of the gasoline, light cycle oil, heavy cycle oil and slurry are basically the same as that described for the gas oil cracker 21. The light gases withdrawn through conduit 51 are basically the same as the light gases withdrawn through conduit 40.

The key to improving the value of the product mix for the refining process illustrated in FIG. 1 is the recycle of the heavy cycle oil flowing through conduit means 55 and the heavy cycle oil flowing through conduit 43 to the hydrofining unit 23. This is accomplished by combining the heavy cycle oil flowing through conduit 43 with the heavy cycle oil flowing through conduit 55 and the combined heavy cycle oil is provided through conduit 27 to the hydrofining unit as previously described.

In the past it has been common to recycle the heavy cycle oil flowing through conduit means 55 and heavy cycle oil flowing through conduit means 43 to the gas oil cracker 21. It has been found that the recycle to the hydrofining unit in accordance with the present invention will improve the value of the product mix with respect to a recycle of the heavy cycle oil to the gas oil cracker. Such improvement will be more fully demonstrated in the example.

The invention has been described in terms of the use of a gas oil cracker and a heavy oil cracker. However, the invention is applicable to a refining process which uses only one catalytic cracking unit with the gas oil from the crude tower and the gas oil and heavy fraction from the hydrofining unit being provided to the single catalytic cracking unit. In such cases, it is believed that the improvement provided by the present invention can be obtained by recycling heavy cycle oil from the single catalytic cracking unit to the hydrofining unit as opposed to recycling the heavy cycle oil back to the single catalytic cracking unit.

If two or more catalytic cracking units are utilized, it is preferred to recycle heavy cycle oil from all of the catalytic cracking units to the hydrofining process. However, if desired, it is believed that a benefit may be obtained by recycling only one heavy cycle oil stream to the hydrofining unit. As an example, the heavy cycle oil flowing through conduit means 43 could be recycled to the gas oil cracker with only the heavy cycle oil flowing through conduit 55 being recycled to the hydrofining unit 23. Again, it is believed that, under such circumstances, an improvement in the value of the product mix will be demonstrated with respect to a process in which all heavy cycle oil is recycled to a catalytic cracking unit.

The following example is presented to demonstrate the benefit of the present invention.

EXAMPLE

Figure 2:
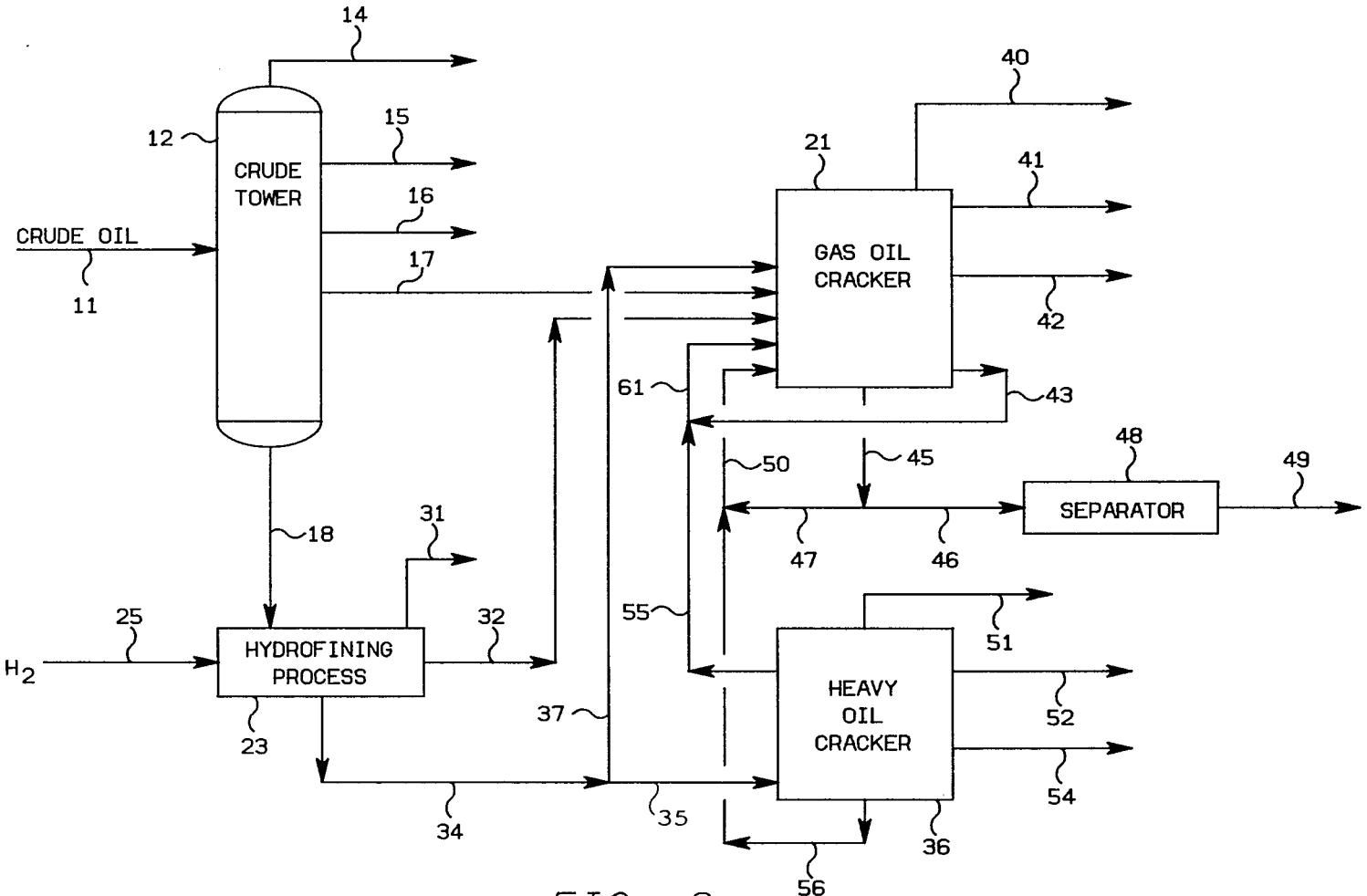
FIG. 2 (PRIOR ART)
FIG. 2 is a diagrammatic illustration of a crude oil refining process employing a heavy cycle oil recycle to the gas oil catalytic cracking unit.

In a plant test, the crude oil refining process illustrated in FIG. 1 was compared to the crude oil refining process illustrated in FIG. 2. The difference in the two crude oil refining processes was that the heavy cycle oil flowing through conduit 55 and 43 was recycled to the gas oil cracker through conduit 61 in FIG. 2 rather than being provided through conduit 27 of FIG. 1 to the hydrofining unit 23.

Pertinent operating conditions and results of the plant test are set forth in Table V. For the test using the inventive refining process, about 3755 barrels per day (BPD) of heavy cycle oil was recycled through conduit 27. For the FIG. 2 test, about 3591 BPD of heavy cycle oil flowed through conduit 61. Only yields from the gas oil cracker 21 were utilized in evaluating the test results.

TABLE V

| Plant Test Results | | |
|---|---|---|
| Yields | FIG. 2 | FIG. 1 |
| $C_2$-(wt % Fresh Feed (FF), Conduit 40) | 3.47 | 3.21 |
| $C_3 + C_4$ (BPD, Conduit 40) | 4,293 | 5,397 |
| Gasoline (BPD, Conduit 41) | 9,059 | 9,156 |
| Light Cycle Oil (BPD, Conduit 42) | 4,125 | 3,961 |
| Heavy Cycle Oil (BPD, Conduit 43) | 3,274 | 2,763 |
| Carbon Black Feed (BPD, Conduit 49) | 2,430 | 2,416 |
| Coke, lb/hr | 36,563 | 34,530 |
| Coke, wt % FF | 11.34 | 10.74 |
| Gasoline, API Gravity | 53.2 | 54.4 |
| Operating Conditions (Gas Oil Cracker 21) | | |
| Feed Temperature, °F. | 534 | 537 |
| Riser Outlet, °F. | 932 | 931 |
| Regenerator Bed Temp, °F. | 1,272 | 1,269 |
| Regenerator ΔT, °F. | 39 | 59 |
| Air Rate, MSCFM | 91.66 | 89.23 |
| Calculated Performance Data | | |
| Wt Balance, % | 101.9 | 101.3 |
| Conversion, Liquid Volumes (LV) % FF | 59.3 | 62.3 |
| Gasoline, LV % Conversion | 63.4 | 60.7 |
| Product Value, $/BBL Converted | 34.17 | 34.46 |
| $H_2$, SCF/BBL Converted | 446.0 | 414.9 |

Referring now to Table V, the results set forth show that the recycle of the heavy cycle oil to the hydrofining process 23 in accordance with the present invention increased the amount of gasoline produced by about 1.1%, reduced the coke make by about 5.6%, increased the API gravity of the gasoline by 1.0° API, reduced the make of heavy cycle oil, light cycle oil and carbon black feed stock, reduced the regenerator bed temperature in the gas oil cracker 21 and reduced the regeneration air rate for the gas oil cracker 21. The net effect was a savings of $2,045 per day from the improved operating conditions and the increased value of the product mix after taking into account added costs of utilities to recycle heavy cycle oil. Also, the conversion of fresh feed was increased with recycle of heavy cycle oil to the hydrofining process 23.

Reasonable variations and modifications are possible within the scope of the disclosure and the appended claims to the invention.

That which is claimed is:

1. Apparatus comprising:

a crude tower;

means for providing a crude oil feed to said crude tower, wherein said crude oil feed is at least partially separated into fractions in said crude tower;

a first catalytic cracking unit for catalytically cracking gas oil;

means for withdrawing a first gas oil fraction from said crude tower and for providing said first gas oil fraction as a feed to said first catalytic cracking unit, wherein said first gas oil fraction is at least partially cracked in said first catalytic cracking unit to produce lighter products and a second heavy cycle oil fraction;

a hydrofining unit;

means for withdrawing a topped crude fraction from the bottom portion of said crude tower and for providing the topped crude fraction as a feed to said hydrofining unit;

a second catalytic cracking unit for catalytically cracking heavy oil;

means for withdrawing the heaviest fraction from said hydrofining unit and for providing at least a portion of said heaviest fraction as a feed to said second catalytic cracking unit, wherein said heaviest fraction is at least partially cracked in said second catalytic cracking unit to produce lighter products and a first heavy cycle oil fraction; and means for withdrawing said first heavy cycle oil fraction from said second catalytic cracking unit and for providing said first heavy cycle oil fraction as a feed to said hydrofining unit; and means for withdrawing said second heavy cycle oil fraction from said first catalytic cracking unit and for providing said second heavy cycle oil fraction as a feed to said hydrofining unit.

2. Apparatus in accordance with claim 1 additionally comprising means for withdrawing a second gas oil fraction from said hydrofining unit and for providing said second gas oil fraction as a feed to said first catalytic cracking unit.

3. Apparatus in accordance with claim 1 additionally comprising means for providing the portion of said heaviest fraction withdrawn from said hydrofining unit, which is not provided as a feed to said second catalyst cracking unit, as a feed to said first catalytic cracking unit.

4. Apparatus comprising:

a crude tower;

means for providing a crude oil feed to said crude tower, wherein said crude oil feed is at least partially separated into fractions in said crude tower;

a first catalytic cracking unit for catalytically cracking gas oil;

means for withdrawing a first gas oil fraction from said crude tower and for providing said first gas oil fraction as a feed to said first catalytic cracking unit, wherein said first gas oil fraction is at least partially cracked in said first catalytic cracking unit to produce lighter products;

a hydrofining unit;

means for withdrawing a topped crude fraction from the bottom portion of said crude tower and for providing the topped crude fraction as a feed to said hydrofining unit;

a second catalytic cracking unit for catalytically cracking heavy oil;

means for withdrawing the heaviest fraction from said hydrofining unit and for providing at least a portion of said heaviest fraction as a feed to said second catalytic cracking unit, wherein said heaviest fraction is at least partially cracked in said second catalytic cracking unit to produce lighter products;

means for withdrawing a first heavy cycle oil fraction from said second catalytic cracking unit and for providing said first heavy cycle oil fraction as a feed to said hydrofining unit;

means for withdrawing a second heavy cycle oil fraction from said first catalytic cracking unit and for providing said second heavy cycle oil fraction as a feed to said hydrofining unit;

means for withdrawing a second gas oil fraction from said hydrofining unit and for providing said second gas oil fraction as a feed to said first catalytic cracking unit; and means for providing the portion of said heaviest fraction withdrawn from said hydrofining unit, which is not provided as a feed to said second catalytic cracking unit, as a feed in addition to said second gas oil fraction feed to said first catalytic cracking unit.

* * * * *